US005355961A

United States Patent [19]

Gariepy et al.

[11] Patent Number: 5,355,961

[45] Date of Patent: Oct. 18, 1994

[54] METAL AND ELASTOMER CASING HANGER SEAL

[75] Inventors: James A. Gariepy; Lawrence A. Eckert, both of Houston, Tex.

[73] Assignee: ABB Vetco Gray Inc., Houston, Tex.

[21] Appl. No.: 42,367

[22] Filed: Apr. 2, 1993

[51] Int. Cl.[5] ..... E21B 33/04

[52] U.S. Cl. ..... 166/387; 166/182; 166/208; 277/117; 285/140

[58] Field of Search ..... 166/115, 182, 208, 387; 277/117, 125, 123; 285/140, 351

[56] References Cited

U.S. PATENT DOCUMENTS

| | | | |
|---|---|---|---|
| 4,521,040 | 6/1985 | Slyker et al. | 285/140 |
| 4,615,544 | 10/1986 | Baugh | 285/18 |
| 4,757,860 | 7/1988 | Reimert | 166/208 |
| 4,823,871 | 4/1989 | McEver | 166/182 |
| 4,842,061 | 6/1989 | Nobileau | 166/115 |
| 4,995,464 | 2/1991 | Watkins et al. | 166/382 |
| 5,076,356 | 12/1991 | Reimert | 166/115 |
| 5,094,297 | 3/1992 | Bridges | 166/382 |

*Primary Examiner*—Hoang G. Dang
*Attorney, Agent, or Firm*—James E. Bradley

[57] ABSTRACT

A casing hanger seal assembly utilizes a deformable metal body and elastomeric seal rings which are O-rings. The seal rings are located in grooves in unbonded condition in the metal body. The inner wall of the metal body is tapered, matching the taper on the exterior of the casing hanger. The inner wall is sized so that it will be deformed outward as the body of the seal assembly is moved further downward. This causes the seal rings on the outer diameter of the body to engage the wellhead housing inner cylindrical wall. In a second version, the seal ring on the outer wall of the body is initially fully recessed. A deformable rib is located inward from the base of the groove. The rib presses the base of the groove outward.

19 Claims, 2 Drawing Sheets

METAL AND ELASTOMER CASING HANGER SEAL

BACKGROUND OF THE INVENTION

1. Field of the Invention

This invention relates in general to seals for wellhead equipment, and in particular to a seal that has a metal carrier that carries elastomers for sealing between a casing hanger and a wellhead housing and which expands radially.

2. Description of the Prior Art

A common well completion system employs a casing hanger which lands in a wellhead housing. The casing hanger has an exterior wall spaced inward from a cylindrical wall of the wellhead housing. The casing hanger is located at the upper end of the string of casing. After the casing has been cemented, a casing hanger seal locates in the annulus between the casing hanger and the wellhead housing.

There are many varieties of casing hanger seals. Some employ elastomeric seals. Others employ metal-to-metal seals. Others utilize a combination of both. While many of these seals are workable, a need exists for a low cost seal that requires a relatively low amount of torque to energize.

SUMMARY OF THE INVENTION

The casing hanger employed with this invention has a tapered wall tapered at an angle of about four degrees. The seal that locates between the tapered wall and the cylindrical wall of the wellhead housing has a metal body. The inner wall of the metal body is tapered at the same angle as the tapered wall of the casing hanger. The outer wall is cylindrical.

At least one groove is located on the inner wall of the body and at least one groove is located on the outer wall of the body. Inner and outer O-rings locate in these grooves, each positioned in unbonded condition to the metal body.

The inner diameter of the metal body is dimensioned so that it will preferably contact the tapered wall before the outer wall of the metal body touches the wellhead housing. Continued downward force causes the metal body to radially expand, permanently deforming the metal body. This expansion causes the other O-ring to be pressed against the cylindrical wall of the wellhead housing.

In one embodiment, the inner and outer O-rings protrude slightly from their respective grooves initially. In another embodiment, the outer O-ring is initially fully recessed within its groove. A protuberance or rib is located on the inner wall, radially inward from the outer groove. The protuberance has a smaller inner diameter than any other portion of the inner wall of the metal body. The protuberance contacts the tapered wall initially prior to any contact by any other portions of the body. Continued downward force causes the rib to move the base of the outer groove radially outward. This pushes the O-ring from its fully recessed position to a protruding position for sealing.

DETAILED DESCRIPTION OF THE INVENTION

Figure 1:
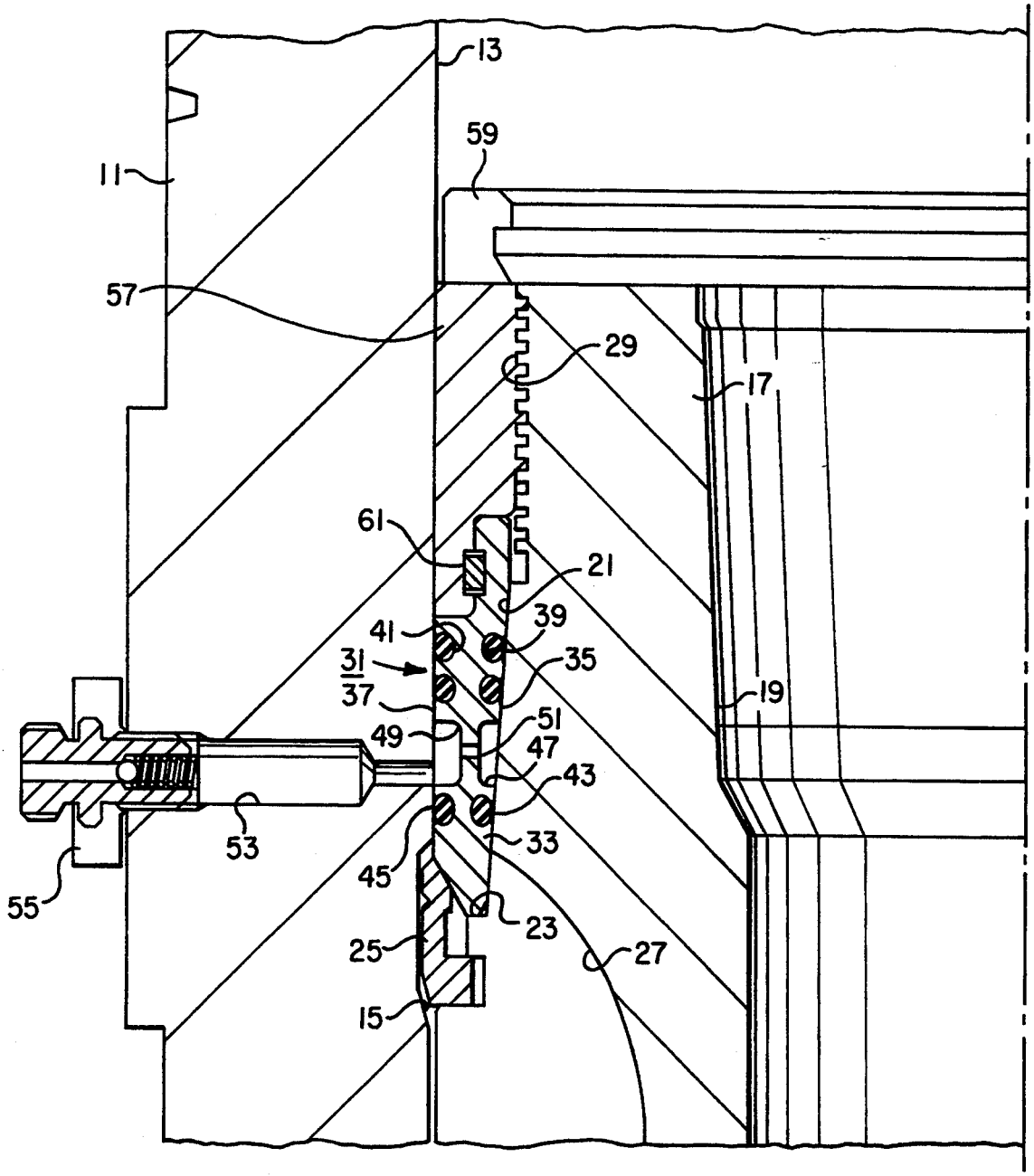
FIG. 1 is a quarter sectional view illustrating a casing hanger seal shown installed between a casing hanger and a wellhead housing, the casing hanger seal being constructed in accordance with this invention.

Referring to FIG. 1, wellhead housing 11 is conventional. Wellhead housing 11 has an axial bore with an inner cylindrical wall 13. An annular recess 15 is formed in cylindrical wall 13.

A casing hanger 17 is shown landed in wellhead housing 11. Casing hanger 17 will be secured to the upper end of a string of casing (not shown). Casing hanger 17 has an axial bore 19 that is coaxial with the bore of wellhead housing 11. Casing hanger 17 has an exterior tapered wall 21 that is spaced radially inward from cylindrical wall 13. Tapered wall 21 is tapered at an angle of about four degrees relative to the axis of bore 19.

Tapered wall 21 has a lower end that terminates at an upward facing shoulder 23. The outer diameter of tapered wall 21 at shoulder 23 is larger than the outer diameter of the upper end of tapered wall 21. Casing hanger 17 carries a split retaining ring 25. Retaining ring 25 will move from a retracted position to an expanded position shown. In the expanded position, retaining ring 25 engages recess 15. Casing hanger 17 has conventional flowby slots 27 to allow cement flow returns. Casing hanger 17 has exterior threads 29 located above tapered wall 21.

A seal assembly 31 seals to tapered wall 21 and cylindrical wall 13. Seal assembly 31 has a metal body 33, which is preferably of steel. Body 33 has an inner wall 35 that is tapered at the same angle of taper as tapered wall 21. Inner wall 35 thus has a larger inner diameter at its lower end than at its upper end. The inner diameter at the lower end of inner wall 35 initially in an undeformed state, is not as large as the outer diameter of tapered wall 21 at shoulder 23. Consequently, when body 33 is lowered over lower casing hanger 17, the inner wall 35 will contact tapered wall 21 and stop further downward movement while the lower end of body 33 is still spaced a half inch or so above shoulder 23. Continued downward force will push body 33 to the position in which its lower end is close to or contacting shoulder 23, however body 33 has to permanently deform and radially expand in order to do so.

Body 33 has an outer wall 37 that is cylindrical. Outer wall 37 has an outer diameter that is initially slightly less than the inner diameter of cylindrical wall 13. Consequently, when body 33 reaches the initial contact position with tapered wall 21 during installation, outer wall 37 will be spaced inward slightly from cylindrical wall 13. Continued downward force will permanently deform the entire metal body 33, expanding outer wall 37 so that normally it will contact cylindrical wall 13 prior to the lower end of body 33 touching shoulder 23. Preferably the amount of expansion is about 0.015 inch radially. Or, if considered as diameter, the outer diameter of outer wall 37 will expand about 0.030 inch. The expansion of outer wall 37 is uniform from the upper end to the lower end of body 33. The tolerance is selected so that preferably the outer wall 37 has reached its full expansion and is touching cylindrical wall 13 before the lower end of body 33 contacts shoulder 23.

In the embodiment of FIG. 1, inner wall 35 has three inner grooves 39, each axially spaced apart from the other. Each inner groove 39 extends circumferentially around inner wall 13. Also, preferably there are three outer grooves 41, each axially spaced apart from the other and extending circumferentially around outer wall 37. Each inner groove 39 is spaced radially inward from one of the outer grooves 41. Each of the inner and outer grooves 39, 41 has a base that is concave and arcuate when viewed in transverse cross-section.

An inner O-ring 43 locates within each inner groove 39. Inner O-ring 43 is an elastomer, initially circular in transverse cross-section in a plane that is parallel to the axis of body 33. Each inner O-ring 43 is conventional, and protrudes slightly from its groove 39 prior to reaching the sealing position shown in FIG. 1. Similarly, each outer groove 41 contains an outer O-ring 45. Each outer O-ring 45 has the same cross-sectional diameter in transverse cross-section. Preferably the radial depths of each inner groove 39 and each outer groove 41 are selected so that approximately ten percent of each inner O-ring 43 and outer O-ring 45 will protrude beyond its respective groove prior to setting. That is, in the undeformed condition, the transverse cross-sectional diameter of each O-ring 43, 45 is ten percent greater than the radial depth of each groove 39, 41.

In the embodiment of FIG. 1, an inner test port groove 47 locates between the lower inner O-rings 43. Similarly, an outer test port groove 49 locates between the lower two outer O-rings 45. Each test port groove 47, 49 extends circumferentially around the metal body 33. At least one test port passage 51 extends radially between inner and outer test port grooves 47, 49. A test port 53 extends radially through the sidewall of wellhead housing 11. A check valve 55 locates in test port 53. This allows hydraulic test pressure to be applied between two of the outer O-rings 45 and two of the inner O-rings 43 for test purposes. The lowest O-ring 39, 41 serves to isolate the application of test pressure so as to allow test pressure to be applied to the lower side of the intermediate O-rings 39, 41. The upper two O-rings 39, 41 serve as primary seals. Test pressure can also be applied to the upper O-rings 39, 41 from above by applying hydraulic pressure to the wellhead housing bore 13.

The means for moving seal assembly 31 downward includes a drive nut 57. Drive nut 57 is a solid metal ring that has inner threads that secure to the external threads 29. Drive nut 57 has lugs 59 on its upper end for engagement by a running tool. Drive nut 57 is rotatable relative to seal assembly 31. A split ring 61 maintains engagement of drive nut 57 with body 33. Split ring 61 locates in mating recesses formed in body 33 and in drive nut 57.

In the operation of the embodiment of FIG. 1, after casing hanger 17 has been installed, and cementing completed, the operator will place seal assembly 31 in the space between the casing hanger 17 and wellhead housing 11. The operator rotates drive nut 57. The first contact that will occur will be the contact of tapered inner wall 35 with tapered wall 21 of casing hanger 17. Because the undeformed inner diameter at the lower end of inner wall 35 is less than the outer diameter of tapered wall 21 at its lower end, this contact will occur when body 33 is a half inch or so above shoulder 23. At the initial point of contact, prior to any deformation of body 33, the outer wall 37 of body 33 will be spaced inward from wellhead housing 11. The outer O-rings 45 may also be spaced inward, or due to tolerances, they may slightly touch at this point. Outer O-rings 45 will not be in sealing engagement, however, at this point.

Continued rotation of drive nut 57 forces body 33 further downward. As body 33 moves further downward, the tapered wall 21 begins expanding body 33. Body 33 undergoes permanent deformation, and will expand in its inner and outer diameters until outer O-rings 45 are in sealing engagement with cylindrical will 13. Sealing engagement of outer O-rings 45 occurs before body 33 touches shoulder 23. Preferably outer wall 37 contacts wellhead housing cylindrical wall 13 before the lower end of body 33 contacts shoulder 23. Shoulder 23 avoids overtorque by limiting the downward travel of body 33. Due to tolerances, body 33 may contact shoulder 23 after O-rings 45 seal but before outer a 37 contacts cylindrical wall 13, and in this instance outer wall 37 will remain spaced slightly from cylindrical wall 13. Once the proper travel has been reached, outer O-rings 45 will be in sealing engagement with inner cylindrical wall 13, being squeezed in the amount of about ten percent. Body 33 will contact and move retaining ring 25 outward into engagement with recess 15 during this downward movement.

If testing is desired, the operator will apply hydraulic fluid pressure through valve 55. The liquid will flow through test port 53 and through test passage 51. The liquid flows around test grooves 47 and 49. The pressure is applied between the lowermost O-rings 43, 45, and the intermediate O-rings 43, 45. The pressure is monitored to determine if any leakage exists.

Figure 2:
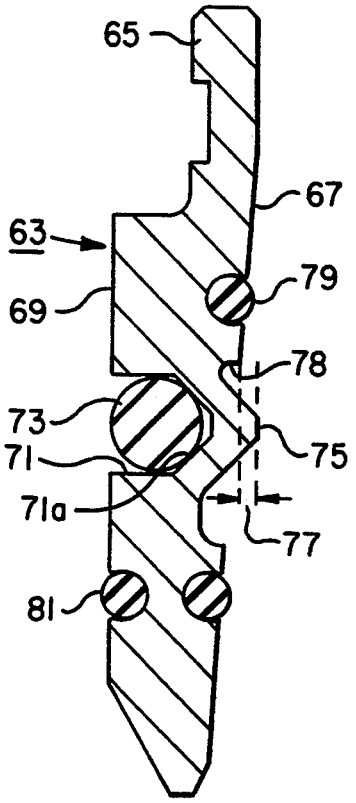
FIG. 2 is a sectional view of an alternate embodiment of a casing hanger seal, shown prior to being set.
Figure 3:
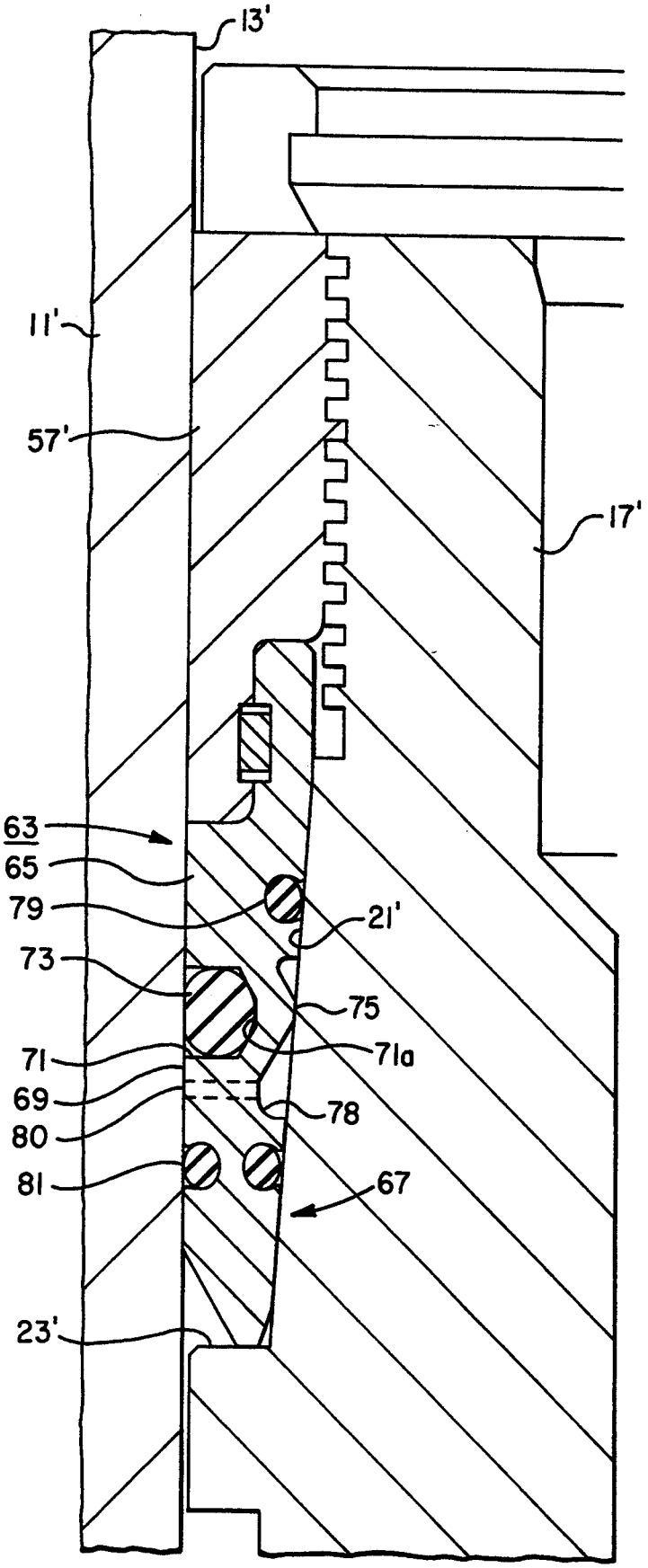
FIG. 3 is a sectional view of the seal of FIG. 2, shown installed between a casing hanger and a wellhead housing.

FIGS. 2 and 3 illustrate an alternate embodiment. In this embodiment, seal assembly 63 also has a metal deformable body 65. Body 65 has an inner wall 67 that is tapered at the same angle of taper as tapered wall 21'. Body 65 has an outer wall 69 that is cylindrical. In its undeformed condition, outer wall 69 is slightly less in outer diameter than the inner diameter of inner cylindrical wall 13' of wellhead housing 11'.

An outer groove 71 is formed in outer wall 69. Outer groove 71 has a base 71*a* that is concave and generally V-shaped in transverse cross-section in an undeformed condition. An outer seal ring 73 locates in outer groove 71. Outer seal ring 73 is preferably an O-ring, circular in transverse cross-section. In the initial undeformed state prior to installation, seal ring 73 will be fully recessed within outer groove 71. No portion of seal ring 73 will protrude from outer groove 71. The depth of outer groove 71 from base 71*a* to outer wall 69 is slightly greater than the transverse cross-sectional diameter of seal ring 73.

A protuberance or rib 75 locates on inner wall 67. Rib 75 is formed radially inward from base 71*a*. Rib 75 is also generally V-shaped in transverse cross-section prior to deformation. Rib 75 protruded radially inward past inner wall 67 a distance equal to deflection distance 77. Deflection distance 77 is an amount that rib 75 will deform when seal assembly 63 is set. Base 71*a* and rib 75 thus combine to provide a web with a general V configuration and thinner in cross-section than any other portion of body 65. Test passage grooves 78 are located above and below rib 75 at the point where rib 75 joins inner wall 67. A radial passage 80 extends through body 65 for communicating test pressure through a check valve (not shown).

A pair of inner seal rings 79 locate above and below rib 75. Inner seal rings 79 are located in grooves and are preferably O-rings, circular in transverse cross-section.

Rib 75 has an undeformed inner diameter that is less than an inner diameter of the inner O-rings 79.

An isolation or lower outer seal ring 81 locates below outer seal ring 73. Seal ring 81 is also preferably an O-ring. The transverse cross-sectional diameter of outer seal ring 73 is larger than the cross-sectional diameters of seal rings 79 and 81. Seal rings 73, 79, 81 are unbonded within their respective grooves.

In the operation of the embodiment of FIGS. 2 and 3, when seal assembly 63 is lowered into the space between casing hanger 17' and wellhead housing 11', rib 75 contacts tapered wall 21' prior to any other contact of inner wall 67 with tapered wall 21'. Seal ring 73 up until that point would be completely recessed within groove 71 so as to avoid any damage due to contacting any structure in the well as the seal assembly 63 is lowered. Continued rotation of drive nut 57' causes the body 65 to move further downward. Tapered wall 21' deforms rib 75 radially outward. As rib 75 moves radially outward, it pushes base **71*a* further outward, causing seal 73 to protrude from its groove 71. Rib 75 will move outward a distance equal to deflection distance 77. At the same time, tapered wall 21' also moves body 65 radially outward, so that outer wall 69 will preferably touch housing cylindrical wall 13' both above seal 73 and below seal 73. The outer diameter of outer wall 69 thus increases uniformly during this deformation. When the seal ring assembly 63 is fully set, the lower end of seal assembly 63 is preferably slightly above or just barely touching shoulder 23'**.

The invention has significant advantages. By using O-rings in unbonded conditions, the expense is lower than bonded specially shaped seals. The unbonded O-rings allow significant deformation of the metal body. The seal thus is of a low cost. Because the deformation occurs on a taper, and is radially outward, the amount of torque required is fairly low. This allows the use of a drive nut, rather than requiring a hydraulic actuator. In the alternate embodiment, the recessed seal ring is protected from damage while being lowered into the well.

While the invention has been shown in only two of its forms, it should be apparent to those skilled in the art that it is not so limited, but is susceptible to various changes without departing from the scope of the invention.

We claim:

1. A seal assembly for sealing an annular space between an outer tubular member and an inner tubular member of a well, the inner tubular member having a tapered wall at a selected angle and the outer tubular member having a cylindrical wall, the seal assembly comprising in combination:

an annular metal body having an inner wall that is tapered to match the angle of the tapered wall of the inner tubular member and an outer wall that is cylindrical;

at least one inner groove on the inner wall of the body and at least one outer groove on the outer wall of the body;

at least one inner O-ring and at least one outer O-ring, each having a transverse circular cross-section and positioned in unbonded condition in each of the inner and outer grooves, respectively; and the inner and outer walls of the body having dimensions selected such that when lowering the seal into the annular space, the inner wall will, initially engage the tapered wall prior to the outer O-ring sealingly engaging the cylindrical wall, then continued downward movement of the body on the tapered wall will permanently deform the body, causing the outer wall of the metal body to increase in diameter and pressing the outer O-ring into sealing engagement with the cylindrical wall.

2. The seal assembly according to claim 1 wherein the inner and outer O-rings are of the same diameter in transverse cross-section.

3. The seal assembly according to claim 1 wherein the inner and outer grooves have radial depths selected so as to provide a squeeze of substantially ten percent when the seal is fully set.

4. The seal assembly according to claim 1 wherein the inner and outer grooves have radial depths that are less than undeformed cross-sectional diameters of the inner and outer O-rings by substantially ten percent.

5. The seal assembly according to claim 1, wherein there are two of the inner grooves on the inner wall axially spaced apart from each other, and two of the outer grooves on the outer wall, axially spaced apart from each other, each of the inner grooves containing one of the inner O-rings and each of the outer grooves containing one of the outer O-rings, the seal assembly further comprising:

an annular test port groove on the inner wall of the body and an annular test port groove on the outer wall of the body, each test port groove located between the axially spaced apart inner and outer grooves on the inner wall and outer wall, respectively; and a test port extending through the body from one test port groove to the other test port groove for allowing test pressure to be applied between the inner and outer O-rings contained in the axially spaced apart inner and outer grooves.

6. The seal assembly according to claim 1, wherein the outer groove has a base with an initial diameter selected to provide a radial depth for the outer groove that is larger than an undeformed transverse cross-sectional diameter of the outer O-ring received therein, causing the outer O-ring received therein to be fully recessed within the outer groove prior to installation of the seal; the seal assembly further comprising:

a protuberance located on the inner wall radially inward from the base of the outer groove and protruding radially inward from the inner wall, the protuberance contacting the tapered wall of the inner tubular member as the body is moved downward, deforming the body and forcing the base of the outer groove radially outward, thereby decreasing the radial depth of the outer groove and pressing the outer O-ring radially outward from the outer groove into sealing engagement with the cylindrical wall of the outer tubular member.

7. In a wellhead having a wellhead housing having a bore with a cylindrical wall, a casing hanger landed therein, the casing hanger having a tapered wall spaced from the cylindrical wall and tapered at a selected angle, defining an annular space, an upward facing shoulder on the casing hanger at a lower end of the tapered wall, an improved seal assembly for sealing the annular space, comprising in combination:

an annular metal body having an inner wall that is tapered at the same angle as the tapered wall of the casing hanger and an outer wall that is cylindrical, the body having an upper end and a lower end;

at least two axially spaced apart inner grooves on the inner wall of the body and at least two axially spaced apart outer grooves on the outer wall of the body;

an inner O-ring having a transverse circular cross-section and positioned in unbonded condition in each of the inner grooves, and an outer O-ring having a transverse circular cross-section and positioned in unbonded condition in each of the outer grooves;

energizing means for moving the body downward in the annular space; and the dimensions of the inner and outer walls of the body being selected such that when the energizing means moves the body downward in the annular space, the inner wall will initially engage the tapered wall while the lower end of the body is spaced above the shoulder and prior to any sealing engagement of the outer O-rings with the cylindrical wall, then continued downward movement of the body will permanently radially expand the body, increasing the diameters of the inner and outer walls and pressing the outer O-rings into sealing engagement with the cylindrical wall.

8. The seal assembly according to claim 7 wherein the outer O-rings sealingly contact the cylindrical wall prior to contact of the lower end of the body with the shoulder.

9. The seal assembly according to claim 7 wherein the casing hanger has a set of external threads, and wherein the energizing means comprises:

a drive nut rotatably secured to the threads, the drive nut slidably engaging the body.

10. The seal assembly according to claim 7 wherein the inner and outer O-rings are of the same diameter in transverse cross-section.

11. The seal assembly according to claim 7 wherein the inner and outer grooves have depths that are less than undeformed cross-sectional diameters of the inner and outer O-rings received therein by substantially ten percent.

12. The seal assembly according to claim 7, further comprising:

an annular test port groove on the inner wall between the inner grooves and an annular test port groove located on the outer wall between the outer grooves; and a test port extending from one test port groove to the other test port groove for allowing test pressure to be applied between the inner O-rings and between the outer O-rings.

13. The seal according to claim 7, wherein one of the outer grooves has a base with an initial diameter selected to provide a radial depth for said one of the outer grooves that is larger that an undeformed transverse cross-sectional diameter of the outer O-ring received therein, causing the outer O-ring received therein to be fully recessed within said one of the outer grooves prior to installation of the seal assembly; the seal assembly further comprising:

an annular protuberance located on the inner wall radially inward from the base of said one of the outer grooves and protruding radially inward from the inner wall, the protuberance contacting the tapered wall of the inner tubular member when the body is moved downward, deforming the body and forcing the base of said one of the outer grooves radially outward, thereby decreasing the radial depth of said one of the outer grooves and pressing the outer O-ring received therein radially outward from said one of the outer grooves into sealing engagement with the cylindrical wall of the outer tubular member.

14. The seal assembly according to claim 7 wherein the inner and outer walls of the body are dimensioned such that all portions of the outer wall will move the same radial distance outward due to the deformation of the body.

15. A seal assembly for sealing an annular space between an outer tubular member and an inner tubular member of a well, the inner tubular member having tapered wall at a selected angle of taper and the outer tubular member having a cylindrical wall, the seal assembly comprising in combination:

an annular metal body having an inner wall that is tapered at the same angle as the tapered wall of the inner tubular member and an outer wall that is cylindrical;

at least one inner groove on the inner wall of the body and at least one outer groove on the outer wall of the body, the outer groove having a base and an undeformed radial depth;

a protuberance on the inner wall radially inward from the base of the outer groove and protruding radially inward from the inner wall;

an elastomeric inner seal ring positioned in each inner groove;

an elastomeric outer seal ring positioned in unbonded condition in the outer groove, the outer seal ring being circular in transverse cross-section and having an undeformed transverse cross-sectional diameter that is smaller than the undeformed radial depth of the outer groove, so that prior to the seal assembly being set, the outer seal ring will be fully recessed within the outer groove; and the inner and outer walls of the body having dimensions selected such that when lowering the seal assembly into the annular space, the protuberance will initially engage the tapered wall, then continued downward movement will permanently deform the body, causing the protuberance to push the base of the outer groove radially outward, pressing the outer seal ring outward from the outer groove into sealing engagement with the cylindrical wall.

16. The seal assembly according to claim 15 wherein the protuberance is annular rib having an undeformed inner diameter that is less than an inner diameter of the inner O-ring.

17. The seal assembly according to claim 15 wherein there are two of the inner grooves and two of the inner seal rings, axially spaced apart from each other and with the protuberance being located between the inner grooves.

18. A method for sealing an annular space between an outer tubular member and an inner tubular member of a well, the inner tubular member having a tapered wall with a selected angle of taper and the outer tubular member having a cylindrical wall, the method comprising:

providing an annular metal body having an inner wall that is tapered at the same angle as the angle of the tapered wall of the inner tubular member and an outer wall that is cylindrical;

forming at least one inner groove on the inner wall of the body and at least one outer groove on the outer wall of the body;

placing in unbonded condition an inner O-ring in the inner groove and an outer O-ring in the outer groove; and lowering the body into the annular space, causing the inner wall to initially engage the tapered wall, then continuing to lower move the body downward on the tapered wall, permanently expanding the inner and outer walls of the body, causing the outer wall of the body to increase in diameter and pressing the outer O-ring into sealing engagement with the cylindrical wall.

19. A method for sealing an annular space between an outer tubular member and an inner tubular member of a well, the inner tubular member having a tapered wall and the outer tubular member having a cylindrical wall, the method comprising:

providing an annular metal body with an inner wall that is tapered to match the tapered wall of the inner tubular member and an outer wall that is cylindrical;

forming at least one inner groove on the inner wall of the body and at least one outer groove on the outer wall of the body, the outer groove having a base and an undeformed radial depth;

forming a protuberance on the inner wall radially inward from the base of the outer groove and protruding radially inward from the inner wall;

positioning an elastomeric inner seal ring in the inner groove;

providing an elastomeric outer seal ring with a circular transverse cross-sectional diameter that is less than the undeformed radial depth of the outer groove, and positioning the outer seal ring in unbonded condition in the outer groove such that prior to setting the outer seal ring will be fully recessed within the outer groove; and lowering the body into the annular space with the protuberance initially engaging the tapered wall, then continuing downward movement of the body, causing the protuberance to push the base of the outer groove radially outward, pressing the outer seal ring outward from the outer groove into sealing engagement with the cylindrical wall.

* * * * *

UNITED STATES PATENT AND TRADEMARK OFFICE

CERTIFICATE OF CORRECTION

PATENT NO. : 5,355,961

DATED : October 18, 1994

INVENTOR(S) : James A. Gariepy, et al.

It is certified that error appears in the above-identified patent and that said Letters Patent is hereby corrected as shown below:

Column 4, line 17, "outer a" should be --outer wall--.

Signed and Sealed this

Second Day of May, 1995

*Attest:*

*Attesting Officer*

BRUCE LEHMAN

*Commissioner of Patents and Trademarks*